United States Patent [19]

Mannion et al.

[11] 4,312,668

[45] Jan. 26, 1982

[54] APPARATUS FOR THE TREATMENT OF MOLTEN METAL

[75] Inventors: Geoffrey Mannion, Horsham; Patrick V. Palmer, Hove, both of England

[73] Assignee: The International Meehanite Metal Company Limited, Surrey, England

[21] Appl. No.: 92,676

[22] Filed: Nov. 9, 1979

[30] Foreign Application Priority Data

Nov. 14, 1978 [GB] United Kingdom ..... 44359/78
May 18, 1979 [GB] United Kingdom ..... 17320/79

[51] Int. Cl.[3] ..... C22C 33/08

[52] U.S. Cl. ..... 75/130 R; 75/53; 75/129; 75/130 A; 75/130 AB; 75/130 B; 75/130 BB

[58] Field of Search ..... 75/130 R, 130 A, 130 B, 75/130 AB, 130 BB, 53, 129

[56] References Cited

U.S. PATENT DOCUMENTS 3,396,777 8/1968 Reding ..... 75/130 R

*Primary Examiner*—Peter D. Rosenberg
*Attorney, Agent, or Firm*—Armstrong, Nikaido, Marmelstein & Kubovcik

[57] ABSTRACT

A treatment unit is disclosed for the introduction of a reactive additive into molten metal and particularly for the introduction of a nodularizing agent into cast iron. The treatment unit is adapted to be located in, on or above a pouring ladle 14 and comprises a pouring bush 1 opening directly or indirectly into a covered additive container 2 which is provided in its base and/or peripheral walls with a plurality of holes to allow the passage therethrough of molten metal. Means are provided, for example a ladle cover 8 or a funnel 21 to accommodate the additive container, for restricting contact of the molten metal being treated with the atmosphere. A process is also disclosed for introducing a reactive additive such as a nodularizing agent into molten metal such as cast iron using the treatment unit.

7 Claims, 9 Drawing Figures

APPARATUS FOR THE TREATMENT OF MOLTEN METAL

This invention relates to an apparatus and to a process for the treatment of molten metal and, in particular, for the production of cast iron.

Methods for the production of cast iron with spheroidal or nodular graphite or graphite forms other than flake normally involve the treatment of cast iron in the liquid state with suitable nodularisers such as Mg, Ca, Na, Li, Sr, Ba, Ce, Di, La, Yt and compounds and alloys thereof.

Many processes have been devised to introduce these nodularisers to cast iron either by direct introduction into a pouring ladle or by use of separate more complicated equipment.

A widely employed method is to place the nodulariser on the bottom of the pouring ladle and then tap molten metal onto it.

In this method the nodulariser may also be covered with steel punchings or inert material.

Other known methods make use of gas agitation and some rely on plunging the nodulariser below the metal surface.

All of these processes suffer certain limitations in that in some instances reliability of treatment is poor and excessive fume, flare, pyrotechnics and metal splashing are experienced due to the violence of reaction between metal and nodulariser. We have, therefore, sought to minimise these problems.

This has been achieved by virtue of the present invention which provides a treatment unit which can conveniently locate onto a pouring ladle.

Thus, the present invention provides a treatment unit which is adapted to be located in on or above a pouring ladle, the treatment unit comprising a pouring bush opening directly or indirectly into an additive container which is provided with a cover and with a plurality of holes in its base and/or peripheral walls to allow the passage therethrough of molten metal and means for restricting contact of molten metal being treated with the atmosphere.

Preferably, the pouring bush opens directly into the additive container and is clamped or otherwise fastened to the additive container by means of an airtight seal. An asbestos seal may be conveniently employed for this purpose. The pouring bush may be centrally disposed above the additive container or, for operating convenience, it may be offset.

The additive container may be any convenient shape such as rectangular and is preferably provided with holes in both its base and in its peripheral walls. The additive container and its cover may be made of steel, for example, with a refractory lining, having an aperture to permit entry of molten metal from the pouring bush.

The additive container may be supported, for example, by a wire cage, coated with ceramic fibres.

According to a particular embodiment, the treatment unit comprises a cover for the pouring ladle. The pouring bush and additive container are adapted to be located in an aperture in the cover and, by this means, the pouring ladle is closed from the atmosphere. In this embodiment the cover of the additive container may be integral with the cover for the pouring ladle.

According to another embodiment, the treatment unit comprises a funnel which is adapted to accommodate the additive container and which serves to restrict contact of molten metal being treated from the atmosphere. In this embodiment the additive container may be provided with two or more support arms adopted to support the additive container in or on the pouring ladle.

According to a particular aspect of this embodiment, the additive container has fastened to it support arms preferably four, which are adapted to fit over the rim of the pouring ladle.

The additive container may comprise a peripheral flange to which the support arms are attached. The peripheral flange is adapted to fit on the top of the funnel and, during a pouring operation the funnel is clamped or otherwise firmly attached to the pouring bush with the additive container being located between the bush and the funnel.

According to this embodiment of the invention the pouring ladle is not essentially provided with a permanent cover and, during a pouring operation, is open in the zones between the support arms of the additive container. We have found that reaction of the molten metal with the reactive additive takes place initially in the additive container and is continued in the funnel which leads into the pouring ladle. Although some reaction still continues in the pouring ladle the force of the reaction has diminished and generally there is no excessive fume and flare as compared for example with a conventional process wherein the molten metal is tapped directly on to the reactive additive contained at the bottom of a pouring ladle. Thus, the provision of the funnel may be sufficient to restrict contact of the molten metal being treated with the atmosphere.

However, we have found that, in some circumstances, it is desirable to provide a temporary cover for the pouring ladle by means, for example, of a refractory material such as a siliceous material placed between the support arms.

The funnel accommodating the additive container may be located, during a pouring operation within the pouring ladle. In this arrangement the funnel extends near to the base of the pouring ladle and splashing of the molten metal is minimized. However, it is envisaged that the additive container can be supported above the pouring ladle in which arrangement the funnel will be either above or only partially within the pouring ladle.

According to a particular aspect of the invention the treatment unit according to the invention is integral with a furnace launder.

The treatment unit according to the invention is suitable for use in metallurgical processes involving the addition of a reactive additive to molten metal, for example desulphurisation and inoculation processes. However, the treatment unit is particularly suitable for use in the production of cast iron wherein a nodularising agent is introduced into molten cast iron.

Thus, the present invention also provides a process for the treatment of molten metal by introduction of a reactive additive which comprises placing the reactive additive in an additive container provided with a cover and in its base and/or peripheral walls with a plurality of holes, passing molten metal to be treated via a pouring bush into the additive container wherein the metal reacts with the additive, and thereafter the metal containing the additive flows through the holes in the additive container into a pouring ladle arranged beneath the additive container, restricting contact of the molten metal being treated with the atmosphere and subsequently processing the treated molten metal in conventional manner.

The integrated ladle treatment unit enables the reactive additive e.g. a nodularising agent, to be gradually introduced into the molten cast iron during filling of the pouring ladle while at the same time minimising air/-metal contact and reducing temperature losses, thus increasing efficiency.

The fact that the additive container is adapted to be situated in or on the pouring ladle allows easy access for re-charging the reacting additive and thus allows increased operator safety.

When the treatment unit is integral with a ladle cover, solution of the reactive additive, e.g. the nodulariser, occurs essentially out of contact with air thus minimising volatilisation and oxidation.

The cover on the ladle during processing also contains the pyrotechnics fume and metal splashing usually associated with a ladle nodularising process.

When the treatment unit is adapted to be supported on the ladle by means of support arms there is no problem in adapting the treatment unit for use with a particular size or shape of pouring ladle. In particular according to this embodiment of the invention, there is no need to provide a ladle cover for each particular ladle employed which is sometimes a disadvantage accompanying conventional processes requiring a ladle cover. Thus, the present invention provides a treatment unit which is versatile and hence economical.

Use of an additive container with a peripheral flange also have the advantage of reducing the pyrotechnics fume and metal splashing usually associated with a ladle nodularising process.

The treatment unit according to the invention may be used for the manufacture of a large casting or a series of castings wherein two or more treatment units are used in conjunction with one pouring ladle. Thus, two or more treatment units according to the invention may be integral with a ladle cover.

In the nodularisation process according to the invention, any of the well known nodularising metals, alloys, compounds or mixtures thereof may be used preferably in lump or compacted/bonded shapes although powder forms may also be used. In the case where a powder is employed it may be necessary to employ means such as guaze or wire either to hold the powder or to line the additive chamber in order to prevent the powder running through the holes prior to a treatment run.

The invention is further illustrated by the accompanying drawings in which:

FIG. 1 is a section through a treatment unit according to the invention;

FIG. 2*a* is a section through a treatment unit according to the invention which is integral with a ladle cover;

FIG. 2*b* is a plan view of part of the unit illustrated in FIG. 2*a;*

Figure 1:
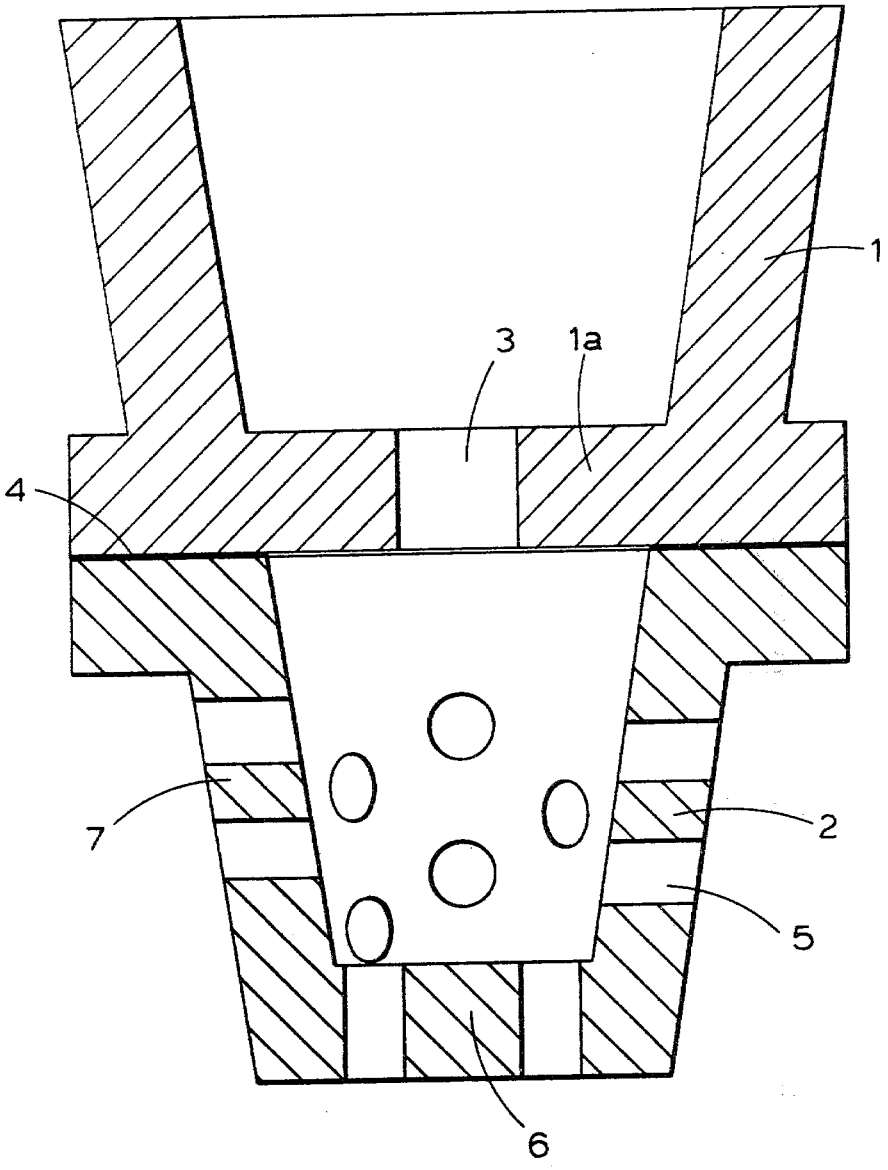

With reference to FIG. 1, the treatment unit comprises a pouring bush 1 which is fastened, for example by clamps (not shown) to an additive container 2. The pouring bush 1 opens via an aperture 3 into the additive container 2. A seal, such as an asbestos seal 4 may be used to ensure an air tight fit and in this arrangement, the base 1*a* of the pouring bush forms the cover for the additive container. The additive container 2 can be made from steel with a refractory lining or it can be made solely from a refractory material. The additive container 2 is formed with a plurality of holes 5 in its base 6 and peripheral walls 7. The treatment unit illustrated may be integral with a cover for a pouring ladle or may include a funnel, for example, in order to restrict contact of molten metal with the atmosphere.

Figure 2A:
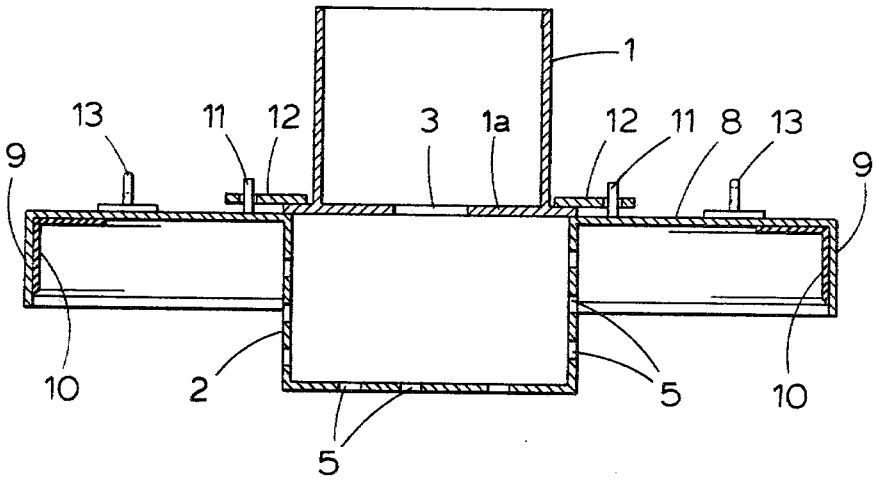
Figure 2B:
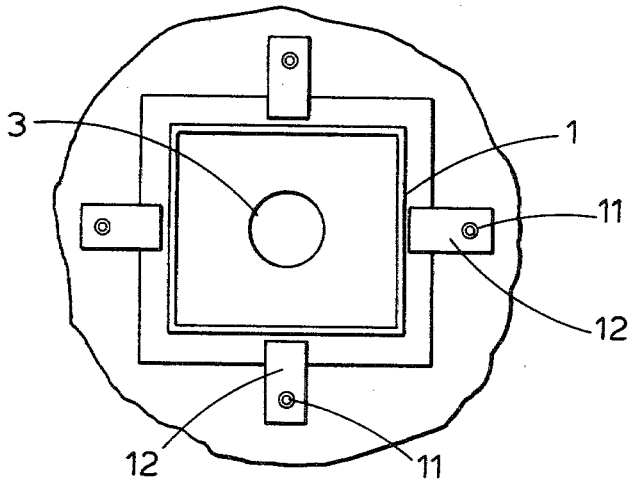

With reference to FIGS. 2*a* and 2*b*, a treatment unit comprising a pouring bush 1 and an additive container 2 provided with holes 5 is integrated in a ladle cover 8. As in FIG. 1, the base 1*a* of the pouring bush 1 effectively forms a cover for the additive container 2. The ladle cover 8 is provided with a flange 9 around its circumference which is adapted to fit over the ladle (not shown) to seal the ladle from the atmosphere. To this end an asbestos seal 10 is located on the underside of the flange 9. The additive container 2 may be welded into the ladle cover 8, as shown in FIG. 2*a*, with its pouring bush 1 being rigidly positioned in the cover 8 by means of welded lugs 11 and top plates 12. Alternatively, the pouring bush 1 may be fixed by means of bolts or hinged fastenings (not shown). The cover plate 8 is also provided with lifting lugs 13 to enable the cover to be removed from the ladle.

Figure 3:
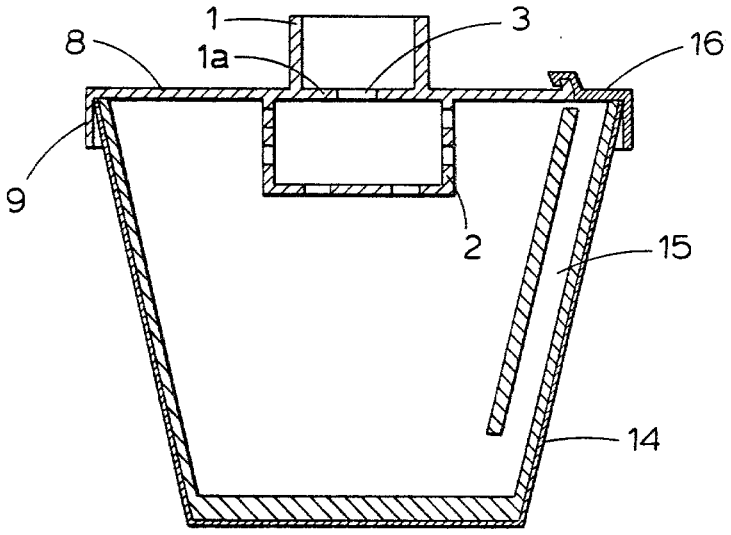
FIG. 3 is a section through a complete treatment unit and pouring assembly according to the invention.

FIG. 3 illustrates the treatment unit integrated in a ladle cover according to the invention in place over a pouring ladle 14. In this arrangement, the base 1*a* of the pouring bush, forming a cover for the additive container, is integral with the ladle cover 8. The flange 9 of the cover 8 fits over the top of the ladle to form an air-tight seal. The ladle 14 includes a conventional spout 15 which is provided with a detachable cover 16 which forms part of the ladle cover 8.

Figure 4:
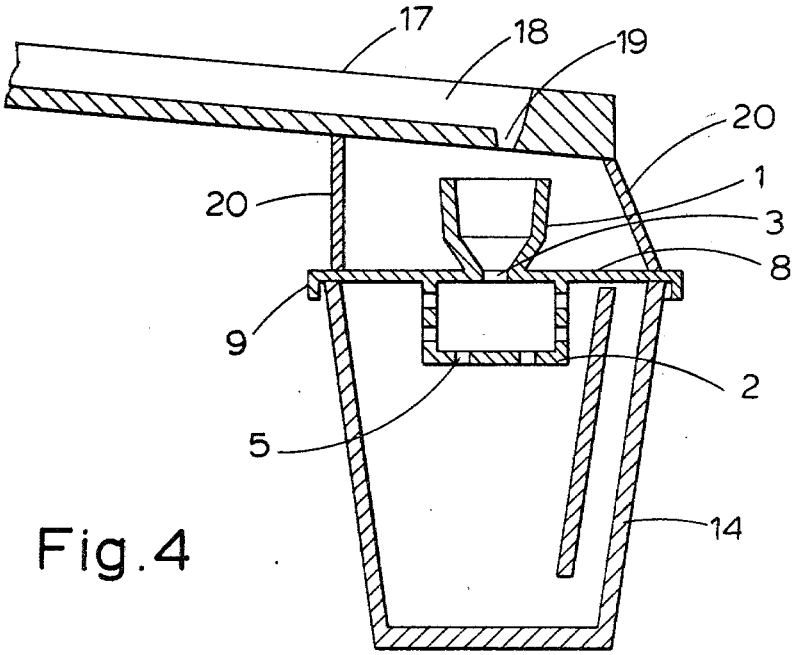
FIG. 4 is a section through a complete treatment unit and pouring assembly shown in cooperation with a furnace launder.

FIG. 4 illustrates a treatment unit integrated in a ladle cover 8 in place over a pouring ladle 14, cooperating with a furnace launder 17. In this arrangement the ladle cover 8 also acts as a cover for the additive container 2. The launder 17 has a channel 18 which leads directly from the furnace (not shown) and opens at an aperture 19 located at one side of the channel 18. The launder 17 is attached to the ladle cover 8 by means of two steel bars 20 at an angle slightly inclined from the horizontal so that molten metal flows under gravity from the furnace down the launder and exits via the aperture 19. The launder 17 is positioned by means of the steel bars 20 so that the pouring bush is located directly below the aperture 19 of the furnace launder.

Figure 5:
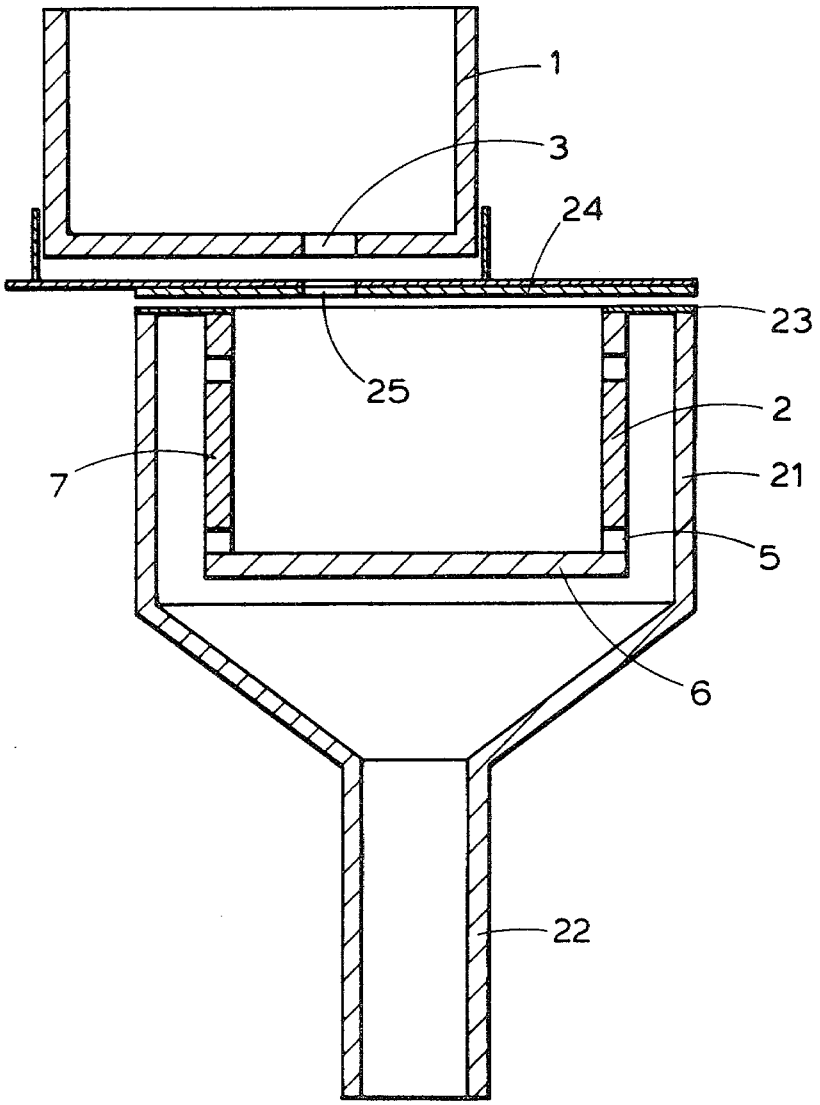
FIG. 5 is a section through another embodiment of a treatment unit according to the invention.

With reference to FIG. 5, the treatment unit comprises an additive container 2 arranged in a funnel 21 tapering to an end portion 22. The additive container 2 is provided with a plurality of holes 5 on its base 6 and peripheral walls 7 and a peripheral flange 23 by means of which the additive container is supported on the funnel 21. The flange 23 is extended by support arms (not shown).

The additive container and funnel can be made from steel with a refractory lining or they can be composed solely of a refractory material. A pouring bush 1 is disposed above the additive container and has an aperture in its base. The additive container 2 is provided with a cover 24 composed for example of refractory-lined steel and having a metal inlet 25 which is situated immediately below the aperture 3 in the pouring bush 1. During a pouring operation the components may be clamped together by means of clamps (not shown). Seals such as refractory seals may optionally be used to ensure air-tight fits. In this embodiment the pouring bush 1 is shown offset from the centre of the additive container.

Figure 6:
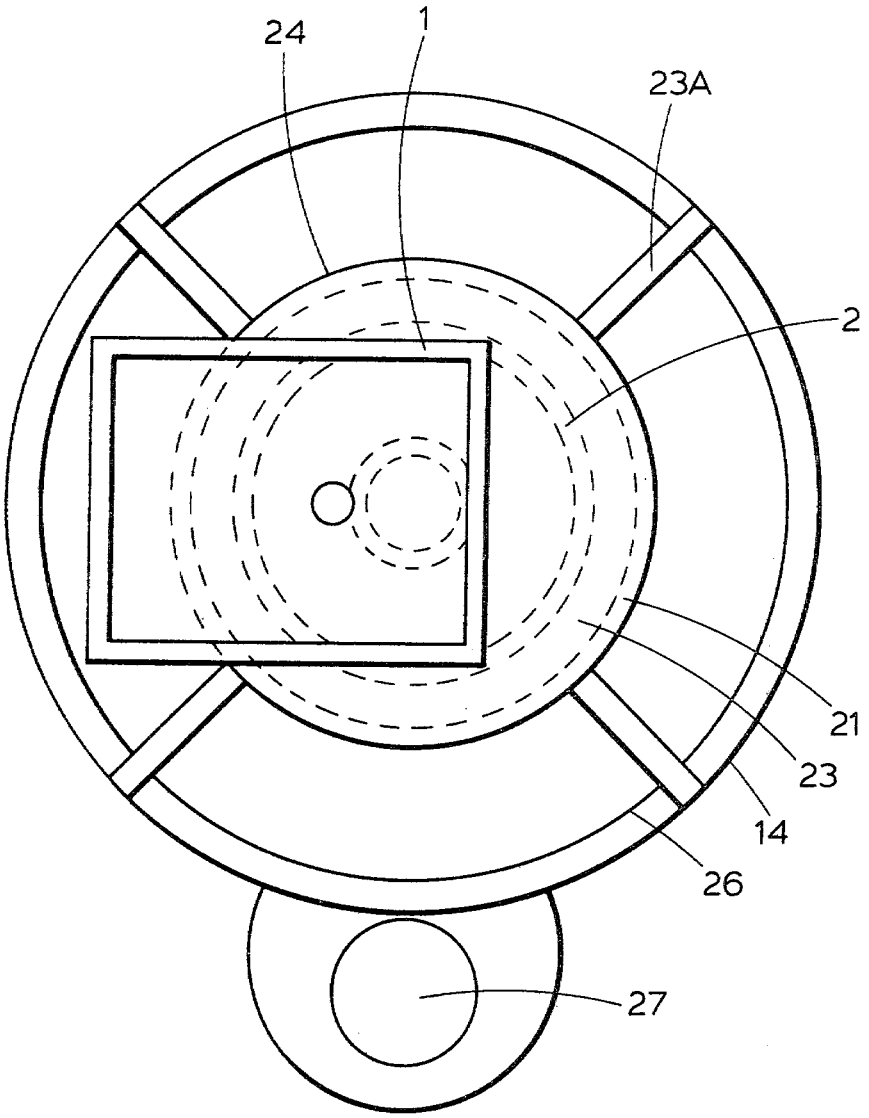
FIG. 6 is a plan view of the embodiment of a treatment unit illustrated in FIG. 5 shown in position in a pouring ladle.

With reference to FIG. 6 a pouring bush 1 is shown above the additive container 2 and slightly offset relative thereto.

The additive container 2 is shown supported by its flange 23 resting on the rim of the funnel 21. The flange is extended by four support arms 23A composed of steel which support the additive container within a ladle 14. The ladle is provided with a refractory lining 26 and a ladle spout 27. A cover plate 24 composed of refractory-lined steel fits over the additive container 2.

Figure 7:
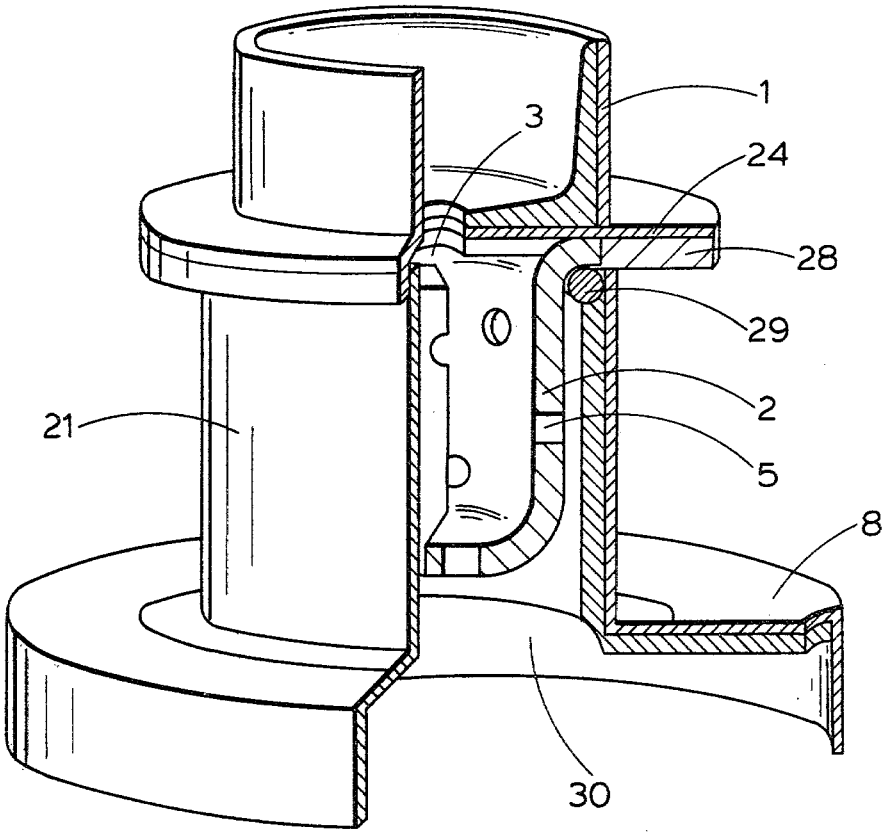
FIG. 7 is a view partly in section of another embodiment of a treatment unit according to the invention which includes a ladle cover.

With reference to FIG. 7, a pouring bush 1 is shown located above and opening into via aperture 3 an additive container 2 provided with holes 5 in its base and peripheral walls. The additive container 2 is provided with a cover plate 24 and is located within a funnel 21 in the form of a flanged tube. The additive container 2 is supported on the upper flange 28 of the funnel 21 a support 29 being provided between the additive container 2 and funnel 21. The funnel 21 is located on a ladle cover 8 and arranged so that the base of the funnel opens into an aperture 30 of the ladle cover 8. The funnel 21 may be integral with the ladle cover 8. The arrangement is such that when the ladle cover is placed on a pouring ladle the whole treatment unit is located above the ladle.

Figure 8:
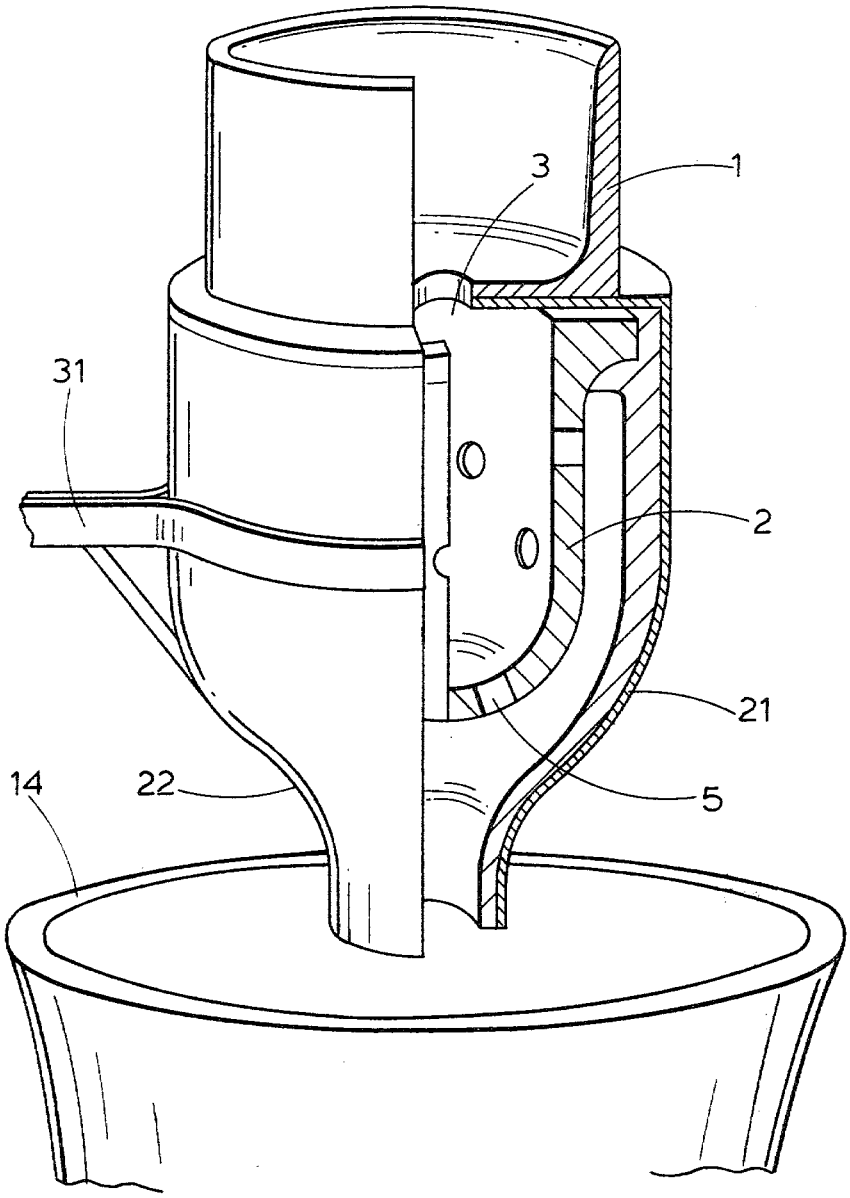
FIG. 8 is a view partly in section of a further embodiment showing a treatment unit according to the invention positioned above a pouring ladle.

Another arrangement of this type is illustrated in FIG. 8 wherein the funnel 21 is provided with a tapered end 22. The funnel 21 is supported by any convenient means such as by a bracket 31 attached to a stand (not shown) so that the tapered end 22 opens into a ladle 14 which is not provided with a permanent cover.

In this arrangement, like that illustrated in FIG. 7, the whole treatment unit is located above the ladle. In this embodiment the provision of the funnel 21 with its tapered end 22 serves to restrict contact of the molten metal being treated with the atmosphere. However, if desired a temporary cover, having as an aperture for location of the funnel, may be provided for the ladle.

In operation, a reactive additive such as a nodularizing agent in lump or compacted form is placed in an additive container in position in a cover located over a pouring ladle, as illustrated, for example, in FIG. 3. Additive may be introduced through the pouring bush directly into the additive container. A furnace launder is positioned with its exit orifice immediately above the pouring bush and molten metal is allowed to flow directly from the furnace via the launder into the pouring bush and subsequently into the additive container. The molten metal reacts with the additive and pours through the holes in the container into the pouring ladle. After a treatment run, the cover for the ladle spout is removed and the treated metal is poured in conventional manner.

Alternatively, in the embodiment illustrated in FIG. 4, wherein the furnace launder 17 and ladle cover 8 are connected together by means of steel bars 20, after a treatment run the ladle 14 containing the molten metal with the reactive additive may be removed for pouring leaving the ladle cover 8 including the treatment unit attached to the furnace launder 17. A ladle 14 is then re-positioned prior to the next treatment run. Removal of the ladle in this way is simpler and less dangerous than removal of the cover after a treatment run. Moreover cleaning of the apparatus is simplified by this arrangement.

In the embodiment illustrated in FIGS. 5 to 8 reaction of the additive with the molten metal takes place mainly in the additive container 2 and the funnel 21. After a treatment run, the additive container and funnel are removed and the treated metal is poured in conventional manner.

The invention is further illustrated by the following Examples which describe a nodularisation process.

EXAMPLE 1

The treatment unit integrated with the ladle cover as shown in FIGS. 2*a* and 2*b* was placed in position on top of a 400 kg capacity ladle, the completed assembly being as illustrated in FIG. 3.

A predetermined quantity of nodularising agent based on a 1.7% addition relative to the amount of molten metal to be treated was placed in the nodulariser container.

In this example the nodulariser used contained a nominal 3% magnesium +2.5% rare earth and was in the form of 6 mm–12 mm lumps.

300 kg of molten flake cast iron of suitable composition was then poured through the treatment unit for a period of some thirty seconds during which time the nodulariser was dissolved, the treated metal being collected in the pouring ladle.

This treatment was accomplished with virtually complete absence of fume or pyrotechnics.

Subsequent examination of treated metal gave the following results.

| METAL COMPOSITION | | | | | |
|---|---|---|---|---|---|
| T.C. | Si | S | Mn | Cu | Mg |
| 3.65 | 2.48 | 0.013 | 0.17 | 0.60 | 0.034 |

| STRUCTURE | |
|---|---|
| Nodular form graphite | Pearlitic matrix |

| MECHANICAL PROPERTIES | |
|---|---|
| Tensile T/sq" | Elongation % |
| 48.0 | 6 |

EXAMPLE 2

The procedure as described in Example 1 was repeated but in this case a base metal composition was chosen so as to produce a nodular structure in a ferritic matrix as compared to a pearlitic one.

As in the case of Example 1 the treatment was accomplished with virtual absence of fume or pyrotechnics.

Examination of the treated metal gave the following results.

| METAL COMPOSITION | | | | |
|---|---|---|---|---|
| T.C. | Si | S | Mn | Mg |
| 4.0 | 2.41 | 0.005 | 0.19 | 0.028 |

| STRUCTURE | |
|---|---|
| Nodular form graphite | Ferritic matrix |

| MECHANICAL PROPERTIES | |
|---|---|
| Tensile t/sq" | Elongation % |
| 30 | 18 |

EXAMPLE 3

A treatment unit as shown in FIGS. 5 and 6 employed on top of a 400 kg capacity ladle.

A predetermined quantity of nodularising agent based on a 1.6% addition relative to the amount of molten metal to be treated was placed in the nodulariser container.

In this Example the nodulariser used contained a nominal 3% magnesium +2.5% rare earth and was in the form of 6 mm–12 mm lumps.

300 kg of molten flake cast iron of suitable composition as shown in the following Table was then poured through the treatment unit for a period of thirty seconds during which time the nodulariser was dissolved, the treated metal being collected in the pouring ladle.

This treatment was accomplished with virtually complete absence of fume or pyrotechnics.

Subsequent examination of treated metal gave the following results.

| METAL COMPOSITION | | | | | |
|---|---|---|---|---|---|
| | % TC | % Si | % S | % Mn | % mg |
| Base iron | 3.93 | 1.57 | 0.006 | 0.16 | — |
| Treated iron | 3.78 | 2.36 | 0.006 | 0.15 | 0.032 |

| STRUCTURE OF TREATED METAL | |
|---|---|
| Nodular form graphite | Ferritic matrix |

| MECHANICAL PROPERTIES TREATED METAL | |
|---|---|
| Tensile t/sq" | Elongation % |
| 30.0 | 21 |

EXAMPLE 4

The procedure as described in Example 3 was repeated using a similar base metal composition.

In this example the nodularising addition was 1.5% as compared to 1.6% in Example 3.

As in the case of Example 3 the treatment was accomplished with virtual absence of fume or pyrotechnics.

Examination of the treated metal gave the following results.

| METAL COMPOSITION | | | | | |
|---|---|---|---|---|---|
| | % TC | % Si | % S | % Mn | % Mg |
| Base Iron | 3.86 | 1.59 | 0.015 | 0.13 | — |
| Treated Iron | 3.88 | 2.28 | 0.015 | 0.13 | 0.034 |

| STRUCTURE OF TREATED METAL | |
|---|---|
| Nodular form graphite | Ferritic matrix |

| MECHANICAL PROPERTIES TREATED METAL | |
|---|---|
| Tensile t/sq" | Elongation % |
| 31.2 | 16 |

We claim:

1. A treatment unit for molten metal which is adapted to be operatively positioned with respect to a pouring ladle such that molten metal poured into the treatment unit is received in the ladle, the treatment unit comprising a pouring bush opening into the top of an additive container, the container including a cover and a plurality of holes provided in at least one of the base or peripheral walls thereof, the holes allowing the passage therethrough of molten metal wherein molten metal poured into the pouring bush flows therethrough into the additive container and out of the holes therein into a pouring ladle, and means for restricting contact of molten metal being treated with the atmosphere.

2. A treatment unit according to claim 1 which includes a cover for the pouring ladle, the cover having an aperture wherein the pouring bush and additive container are positioned within the perimeter of the aperture.

3. A treatment unit according to claim 1, which includes a funnel adapted to accommodate the additive container.

4. A treatment unit according to claim 3 wherein the additive container includes at least two support arms adapted to support the additive container on the pouring ladle.

5. A treatment unit according to claim 3 or 4 which includes a cover for the pouring ladle, the cover having an aperture wherein the pouring bush, additive container and funnel are positioned within the perimeter of the aperture.

6. A treatment unit according to any one of claims 1 to 4, wherein the pouring bush is integral with a furnace launder.

7. A treatment unit according to any one of claims 1 to 4 which further comprises a pouring ladle.

* * * * *